United States Patent [19]

Guerrero et al.

[11] Patent Number: 4,487,467

[45] Date of Patent: Dec. 11, 1984

[54] ELECTRIC CONNECTION DEVICE FOR COUPLING MULTIPLE-CONDUCTOR CABLES

[75] Inventors: Michel Guerrero; Didier Doret, both of Suresnes, France

[73] Assignee: Socapex, Suresnes, France

[21] Appl. No.: 355,338

[22] Filed: Mar. 8, 1982

[30] Foreign Application Priority Data

Mar. 10, 1981 [FR] France ..... 81 04718

[51] Int. Cl.[3] ..... H01R 25/00; H01R 13/639

[52] U.S. Cl. ..... 339/49 R; 339/75 M; 339/94 M

[58] Field of Search ..... 339/47 R, 48, 49 R, 339/49 B, 75 M, 75 R, 94 M

[56] References Cited

U.S. PATENT DOCUMENTS 2,281,739 5/1942 Wright ..... 339/75 R
4,249,788 2/1981 McNeel ..... 339/49 R X
4,303,292 12/1981 McNeel ..... 339/49 R X

FOREIGN PATENT DOCUMENTS 453456 6/1968 Switzerland ..... 339/75 R
1094473 12/1967 United Kingdom ..... 339/154 R

*Primary Examiner*—Eugene F. Desmond
*Assistant Examiner*—Steven C. Bishop
*Attorney, Agent, or Firm*—Oblon, Fisher, Spivak, McClelland & Maier

[57] ABSTRACT

The device for connecting multiple-conductor cables is composed of two hermaphroditic connectors which are coupled by means of their electric connection face, the first connector being joined to the input cable and the second connector being joined to the output cable. Locking after coupling of said connectors is performed by means of U-shaped stirrups, the respective arms of which are swung back to a position along the longitudinal sides of the connectors. The pivotally mounted ends of the stirrup arms are each provided with a member having an engagement slot and a locking recess in which is engaged a projecting portion of the body of the other connector.

10 Claims, 2 Drawing Figures

ELECTRIC CONNECTION DEVICE FOR COUPLING MULTIPLE-CONDUCTOR CABLES

This invention relates to electric connection devices for coupling two multiple-conductor cables and especially electric cables employed in geophysical research.

Cable-connecting devices for geophysical research are usually constituted by a pair of hermaphroditic connectors each having an electric connection face which is coupled to a multiple-conductor cable. Each connection face comprises a group of male conductors and a group of female conductors. By joining the two connection faces together, an electrical coupling is established between the cable which is joined to one connector and the cable which is joined to the other connector.

By reason of the extremely varied character of ground areas explored in the field of geophysical research, devices of the type mentioned above must afford resistance to conditions arising from the nature of the ground (sand, mud, water, snow, ice) as well as to the atmospheric conditions (low temperatures, high temperatures, humidity, rain) which may be encountered in these areas. Imperviousness of these devices with respect to the factors set forth in the foregoing must therefore be ensured. To this end, provision is usually made for a resilient seal which is compressed at the moment of coupling of the connectors, this being achieved by actuating locking means. It must further be ensured that this operation can be performed rapidly by unqualified personnel.

Electric connection devices which are already in use for coupling two electric cables do not fully satisfy these conditions since they are usually attended by at least one of the following disadvantages:

- the difficulty involved in actuating the locking means at low temperature, thereby entailing the need to employ specialized tool equipment;
- possible seizure of the locking means as a result of introduction of foreign particles within the locking grooves, thus adversely affecting the standard of fluid-tightness;
- failure of the locking means to provide a clear indication of the end of travel, thereby entailing a potential danger of unlocking or of defective fluid-tightness.

In order to overcome the disadvantages of devices of the prior art, the object of the present invention is to provide an electric connection device for coupling multiple-conductor cables, comprising a pair of hermaphroditic connectors each having an electric connection face composed of a group of male connection conductors and of a group of female connection conductors coupled to a multiple-conductor cable. Said groups are mounted in such a manner as to ensure that they can be connected respectively to groups of female and male connection conductors of the electric connection face whicn is coupled to a multiple-connector cable of the other hermaphroditic connector. Each connector is further provided with mechanical locking means for ensuring electrical and mechanical interconnection of the groups of conductors which are engaged one within the other as well as compression of resilient means for ensuring imperviousness of the device in the locked state. The locking means of each connector comprise a locking stirrup mounted on the connector body so as to be capable of pivotal displacement between a position in which the two connectors are unlocked and separately movable and a position in which the two connectors are locked. The locking operation is performed by causing the stirrups to rotate to a position behind end faces respectively of the connector covers. During this rotational displacement, projecting portions on the bodies of the two connectors are engaged within means provided in the locking stirrups.

Other features of the invention will be more apparent upon consideration of the following description and accompanying drawings, wherein.

Figure 1:
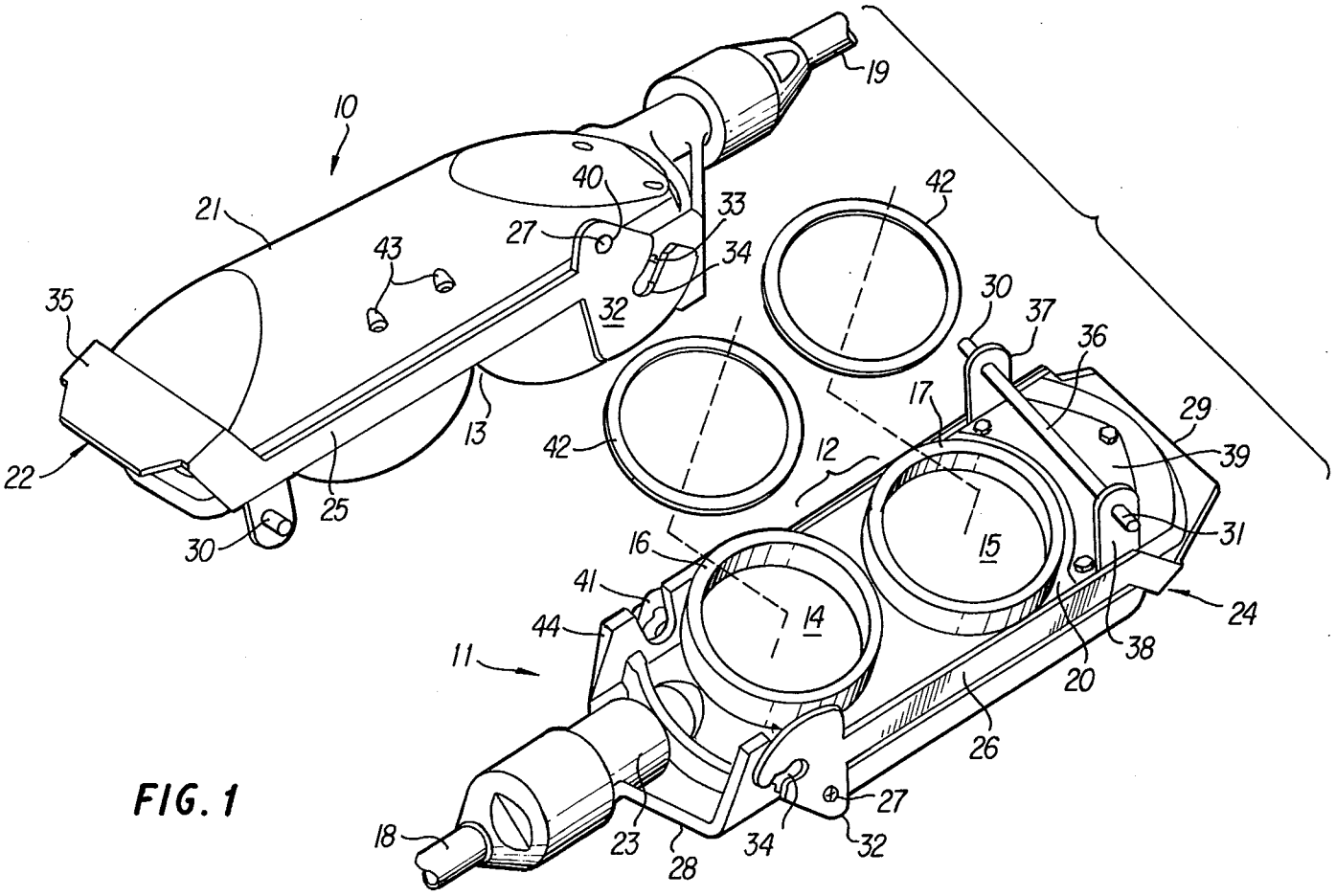
FIG. 1 is a perspective view of the pair of hermaphroditic connectors which composes an electric connection device according to the present invention.

The hermaphroditic connectors 10 and 11 shown in FIG. 1 are equivalent both in regard to electrical function and in regard to the shape of the connector bodies. The upper portion of FIG. 1 is more particularly a view of the rear side of the connector 10 whereas the lower portion of this figure is a view of the electric connection face 12 of said connector.

The two connectors 10 and 11 are located in a position in which coupling of these latter can be effected simply by bringing the two electric connection faces 12 and 13 together. Each face 12 and 13 is composed of a group 14 of male connection conductors (not shown in the figures) which is housed within a compartment 16 of cylindrical shape, and of a group 15 of female connection conductors (not shown). Said group 15 is also housed within a compartment 17 having a shape which is similar to the compartment 16 and which is contiguous with this latter.

The groups of conductors of a connector are joined in the desired manner to the strands of one of the multiple-conductor cables 18 and 19 which are intended to be coupled by means of said device. The male and female conductors are complementary. In other words, the male and female conductors of one connector can be coupled respectively to the female and male conductors of the other connector.

Leading-in of the strands of a cable and connection of these latter to the connection conductors housed within the compartments 16 and 17 are carried out within another compartment (not shown in the figures) formed between a wall 20 which supports the two compartments 16 and 17 and an outer or dorsal wall 21 of the connector. Preferably, said wall 21 constitutes a cover which protects all the internal connections with the cable. Consideration being given by way of example to the cable 18, this latter is connected through a cylindrical sleeve 23 which is rigidly fixed to an ehd portion 28 of the body of the connector 11.

The axis of said sleeve 23 is aligned with the successive centers of the two compartments 16 and 17 and coincides with the longitudinal axis of symmetry of the connector.

A U-shaped locking stirrup 22 or 24 is mounted on each connector body and has two parallel arms 25 and 26 pivotally mounted on a cross-pin 27 which is attached to the wall 21 of the cover and is perpendicular to the longitudinal axis of symmetry of the connector body. Said cross-pin 27 is preferably located near the end portion 28 of the connector body which is rigidly fixed to the sleeve 23.

The locking stirrup 22 or 24 is capable of pivotal displacement between a position in which the two connectors 10 and 11 are unlocked and separately movable and a position in which they are locked. The locking operation is carried out by means of projecting portions 30 and 31 located externally with respect to the bodies of the two connectors 10 and 11. Said projecting portions are adapted to engage within locking recesses 34 formed in a flat member 32 one of which is rigidly attached to the ends of the two arms of each stirrup 22 and 24.

The spacing or distance between the two arms 25 and 26 is so determined that, in the locking position, said arms extend along the connector body on which they are mounted. A handle 35 which forms a bridge between the two arms 25 and 26 and serves to actuate the locking stirrup is moved back in this case to a position behind an end face 29 of the connector, namely at the end remote from the end face 28 at which the cable is connected to the connector.

The projecting portions 30 and 31 are preferably constituted by the ends of a rod 36 which is placed on the side corresponding to the connection face 12, transversely with respect to the longitudinal axial direction, and at the end portion 29 remote from the end 28 which is connected to the cable.

The ends of the rod 36 are carried by two upright members 37 and 38 which are rigidly fixed to a flat support 39, said support being screwed to the wall 20 which carries the two compartments 16 and 17.

A flat member 32 having the shape of a circle sector is rigidly fixed at each end of the arms of the stirrups 22 and 24 and capable of carrying the pivotal displacement means 40 which are mounted on the cross-pin 27. A slot 33 having the shape of a circular arc is formed in said flat member 32 and centered on the pivotal displacement means 40, the locking recess 34 being formed in an internal edge of each slot.

The slots 33 are formed so as to have a slightly greater width, for example, than the corresponding projecting portions 30 and 31 with a view to ensuring that the edges of said slots 33 serve to assist the locking and unlocking action of the connector. This assisted action is achieved by causing the projecting portions 30 and 31 to cooperate with one edge of the slots 33 which thus forms a cam at the time of locking of the connectors and with the other edge which forms a cam at the time of unlocking of these latter. This accordingly produces an extremely beneficial and useful leverage effect. It will be noted in this respect that the force of insertion and uncoupling of geophysical connectors may attain several tens of daN.

The means 40 for pivotal displacement of the sector 32 preferably comprise a bore at the vertex of the angle of rotation of the sector, usual means being provided for retaining said bore on the cross-pin 27 such as screws or a flattened end of the pin 27 outside the bore.

The two longitudinal edges of a connector body are parallel to its longitudinal axis of symmetry. A sloping wall 44 formed at both ends of said longitudinal edges stops in the vicinity of the contiguous compartment 16 and is of smaller height than this latter. In each wall is formed a notch 41 for supporting the ends 30 and 31 of the rod 36 which are inserted therein at the moment of coupling of the two electric connection faces 12 and 13.

Figure 2:
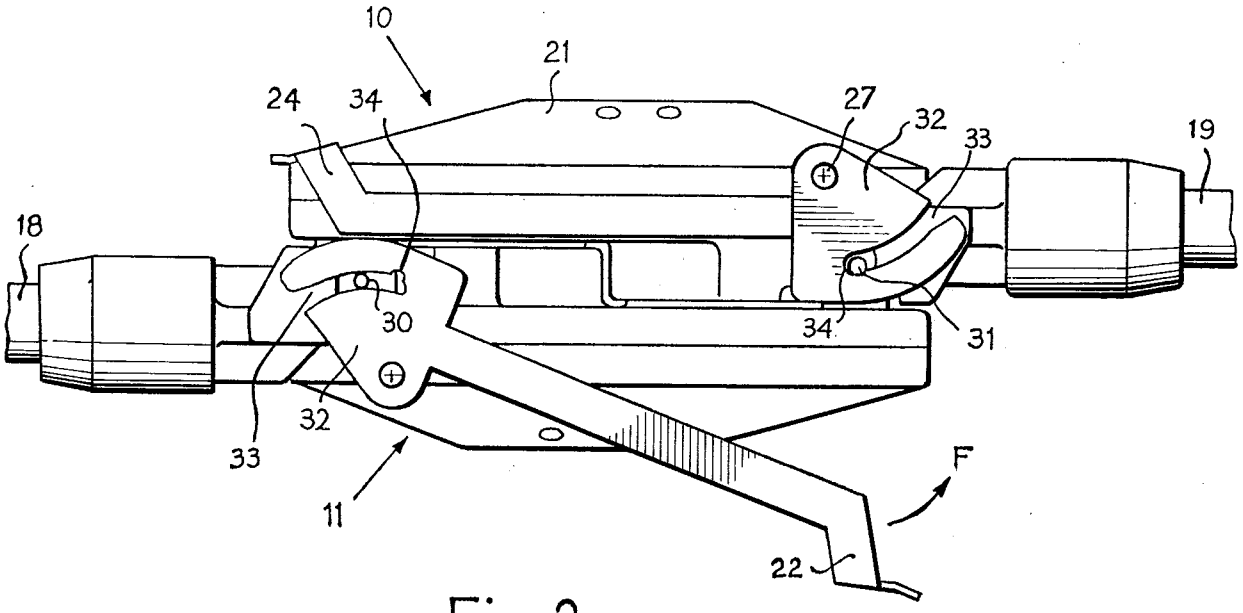
FIG. 2 is a view of a longitudinal side of the device after assembly of the pair of hermaphroditic connectors shown in FIG. 1. For the sake of better understanding, one element is shown in the locked condition and the other element is shown during the locking operation.

FIG. 2 shows the device according to the invention in which one stirrup 24 is in the locking position whilst the other stirrup 22 is in a position which precedes the locking position.

Prior to coupling of the two faces 12 and 13, the arms of the stirrups 22 and 24 are directed outwards with respect to their cover 21. During the coupling operation, the projecting ends 30 and 31 of the rods 36 are placed within the respective notches 41 of each connector at the same time. The stirrups 22 and 24 are then displaced in pivotal motion so as to engage the projecting ends 30 and 31 of the rods 36 of a connector successively within the engagement slots 33 and if necessary within the respective locking recesses 34 of the stirrup of the other connector. At the end of the locking operation, the handles 35 of each stirrup are moved back in the direction of the arrow F to a position behind the end face of the cover 21. An accurate indication in regard to the state of locking of the device is provided by the position of the projecting end portions 30 and 31 within the respective locking recesses 34.

By virtue of the symmetrical arrangement of these two stirrup assemblies, the two stirrups 22 and 24 are locked simultaneously by the operator who holds one stirrup in each hand. Furthermore, as a result of the cooperation between the four engagement slots 33 and the corresponding projecting portions 30 and 31, said simultaneous locking action in turn results in progressive linear guidance of the two connectors at the time of locking and unlocking.

In order to ensure imperviousness of the device which has thus been locked, an interfacial resilient seal 42 is interposed beforehand between the circular edge of the compartment 17 of the connector 11 and the periphery of the group which is housed within the compartment 16 of the other connector 10. Since said seal 42 is thus compressed, it exerts a force in opposition to the compression force and hence a thrust which tends to maintain the projecting ends 30 and 31 of the rods 36 of one connector within the respective locking recesses 34 of the stirrup of the other connector.

The electric connection device in accordance with the design described in the foregoing can readily be cleaned. The entire body of the device is preferably molded from high-strength plastic material, but the rods 36 and the stirrups which are subjected to high stresses are formed of metal.

The device can also be provided with electric contacts 43 for establishing a telephone cable connection. By way of example, these contacts can pass through the wall of the cover 21 of the device and can be connected to the strands of a cable.

What is claimed is:

1. An electric connection device for coupling multiple-conductor cables, said device comprising a pair of hermaphroditic identical connectors each having an electric connection face composed of a group of male connection conductors and of a group of female connection conductors coupled to a multiple-conductor cable, said groups being mounted in such a manner as to ensure that they can be connected respectively to groups of female and male connection conductors of the electric connection face which is coupled to a multiple-connector cable of the other hermaphroditic connector, each connector being further provided with mechanical locking means for ensuring electrical and mechanical interconnection of the groups of conductors within the other connector as well as compression of resilient means for ensuring imperviousness of the device in the locked state, wherein the mechanical locking means of each connector comprise a locking stirrup mounted on the connector body so as to be capable of pivotal displacement between a position in which the two connectors are unlocked and separately movable and a position in which said two connectors are locked, the locking operation being performed by causing the stirrups to rotate to a position behind end faces respectively of covers of the connectors, projecting portions on the bodies of the two connectors being engaged during the rotational displacement of said stirrups within means provided in the locking stirrups, each locking stirrup being pivotally mounted on a cross-pin which is disposed transversely with respect to the longitudinal axial direction of the body of the associated one of said connectors and with respect to the direction of coupling of the multiple-conductor cable which is joined to the associated one of said connectors, said cross-pin being disposed in proximity of a first connector end face remote from a second connector end face behind which the end portion of the stirrup is positioned and located opposite said first connector end face, each projecting portion of each connector body being constituted by an end portion of a rod mounted on one connection face transversely with respect to the axial direction of the body of the associated one of said connectors and located at said second end face.

2. A device according to claim 1, wherein each cable is coupled respectively to each first connector end face.

3. A device according to claim 1, wherein the ends of the arms of a stirrup are each adapted to carry a member which is rigidly attached to said arms, said member being provided with means for pivotal displacement on said cross-pin and with an engagement slot having the shape of a circular arc, said engagement slot being provided with a locking recess in one internal edge of said slot, whereby said engagement slot serves to assist the locking and unlocking action by cooperating with said projecting portions.

4. A device according to claim 1, wherein each stirrup for clamping a connector is fitted with a handle forming a bridge between two arms of said stirrup and applied in the locking position of the stirrup against one end face of a cover, said end face being remote from the end portion to which the connector cable is coupled.

5. A device according to claim 1, wherein the projecting portions are pressed within locking recesses of each locking stirrup as a result of expansion of an interfacial resilient seal which is compressed between the two connectors.

6. A device according to claim 1, wherein the projecting portions are housed within notches formed in upright longitudinal walls extending along the two longitudinal edges of a connector between said first end face and a compartment in which the connecting conductors of the connector are housed.

7. A device according to claim 2, wherein the projecting portions are housed within notches formed in upright longitudinal walls extending along the two longitudinal edges of a connector between said first end face and a compartment in which the connecting conductors of the connector are housed.

8. A device according to claim 1 wherein the connector cover is fitted with electric contacts for a telephone connection, said contacts being passed through the connector wall and coupled to strands of the cable which is joined to the connector.

9. An electric connection device for coupling multiple-conductor cables, said device comprising a pair of hermaphroditic identical connectors each having an electric connection face composed of a group of male connection conductors and of a group of female connection conductors coupled to a multiple-conductor cable, said groups being mounted in such a manner as to ensure that they can be connected respectively to groups of female and male connection conductors of the electric connection face which is coupled to a multiple-connector cable of the other hermaphroditic connector, each connector being further provided with mechanical locking means for ensuring electrical and mechanical interconnection of the groups of conductors within the other connector as well as compression of resilient means for ensuring imperviousness of the device in the locked state, wherein the mechanical locking means of each connector comprises a locking stirrup mounted on the connector body so as to be capable of pivotal displacement between a position in which the two connectors are unlocked and separately movable and a position in which said two connectors are locked, the locking operation being performed by causing the stirrups to rotate to a position behind end faces respectively of covers of the connectors, projecting portions on the bodies of the two connectors being engaged during the rotaitonal displacement of said stirrups within means provided in the locking stirrups, said projecting portions being housed within notches formed in upright longitudinal walls extending along the two longitudinal edges of each connector between an end face thereof and a compartment in which connecting conductors of the connector are housed.

10. A device according to claim 9, wherein said cable is connected to said end face adjacent to said notches.

* * * * *